US011122912B2

(12) United States Patent
Massale

(10) Patent No.: US 11,122,912 B2
(45) Date of Patent: Sep. 21, 2021

(54) SLIPCOVER STRAP HOOK

(71) Applicant: Hills Point Industries, LLC, Westport, CT (US)

(72) Inventor: John Massale, Morrison, CO (US)

(73) Assignee: Hills Point Industries, LLC, Westport, CT (US)

( * ) Notice: Subject to any disclaimer, the term of this patent is extended or adjusted under 35 U.S.C. 154(b) by 66 days.

(21) Appl. No.: 16/593,361

(22) Filed: Oct. 4, 2019

(65) Prior Publication Data

US 2020/0107648 A1 Apr. 9, 2020

Related U.S. Application Data

(60) Provisional application No. 62/741,420, filed on Oct. 4, 2018.

(51) Int. Cl.

| | |
|---|---|
| ***A44B 11/00*** | (2006.01) |
| ***A44B 11/04*** | (2006.01) |
| ***A47C 31/11*** | (2006.01) |
| ***A44B 11/28*** | (2006.01) |

(52) U.S. Cl.

CPC ..... *A47C 31/11* (2013.01); *A44B 11/28* (2013.01)

(58) Field of Classification Search

CPC ..... A47C 31/11; Y10T 24/318; Y10T 24/27; Y10T 24/40; Y10T 24/2192; Y10T 29/49826; Y10T 24/1394; Y10T 403/453; Y10T 403/54; A44B 11/2592; A44B 11/006; F16B 21/18; F16B 17/00; F16B 2200/20; F16B 2/08

See application file for complete search history.

(56) References Cited

U.S. PATENT DOCUMENTS

| | | | | | |
|---|---|---|---|---|---|
| 2,269,696 | A * | 1/1942 | Shaulson | A41F 11/02 | 24/200 |
| 2,276,595 | A * | 3/1942 | Shaulson | A44B 11/04 | 24/200 |
| 2,285,714 | A * | 6/1942 | Hirsh | A44B 11/04 | 24/199 |
| 2,293,562 | A * | 8/1942 | Rosenthal | A44B 11/04 | 24/200 |
| D157,386 | S * | 2/1950 | Lombardi | D11/218 | |
| 5,733,002 | A * | 3/1998 | Riley | A47C 31/11 | 24/326 |
| 6,351,874 | B1 * | 3/2002 | Suggs | A44B 11/006 | 24/265 BC |
| 7,100,249 | B2 * | 9/2006 | Hum | A44B 11/04 | 24/199 |
| 7,448,681 | B1 * | 11/2008 | Spitzer | A47C 31/11 | 2/69 |
| 7,959,227 | B2 * | 6/2011 | Miller | A47C 31/11 | 297/224 |

(Continued)

*Primary Examiner* — Shin H Kim

(74) *Attorney, Agent, or Firm* — Gordon & Jacobson, P.C.

(57) ABSTRACT

A slipcover hook includes a first closed ring and a second open ring connected to the first closed ring. The second open ring has a slot located in spaced relation to the lateral sides of the hook. In one embodiment, the intermediate slot is located equidistantly from the lateral sides (i.e., in or proximate to the center). The first and second closed ring are coplanar. The central opening is configured to permit the passage of a loop of fabric through the gap or opening so that the loop can be introduced into or removed from the second opening.

19 Claims, 4 Drawing Sheets

(56) References Cited

U.S. PATENT DOCUMENTS

| | | | | |
|---|---|---|---|---|
| 8,210,179 | B2 * | 7/2012 | Eaton | A61M 16/0655 128/206.24 |
| 8,573,692 | B2 * | 11/2013 | Nazginov | A47C 31/11 297/225 |
| 9,380,838 | B2 * | 7/2016 | Iannello | A45F 5/00 |
| D801,221 | S * | 10/2017 | Paik | D11/218 |
| D815,982 | S * | 4/2018 | Chang | D11/218 |
| 10,004,300 | B2 * | 6/2018 | Waller | A63B 33/002 |
| D824,800 | S * | 8/2018 | Blume | D11/200 |
| 10,835,001 | B2 * | 11/2020 | Ressler | A44B 11/04 |
| 2002/0043834 | A1 * | 4/2002 | Jackson | A47C 31/11 297/228.1 |
| 2004/0226147 | A1 * | 11/2004 | Fildan | A44B 11/04 24/302 |
| 2005/0066484 | A1 * | 3/2005 | Hum | A44B 11/04 24/321 |
| 2006/0103197 | A1 * | 5/2006 | Baines | A47C 31/11 297/229 |
| 2007/0163689 | A1 * | 7/2007 | Pace | A45C 3/08 150/105 |
| 2007/0200403 | A1 * | 8/2007 | Nazginov | A47C 31/11 297/228 |
| 2007/0271703 | A1 * | 11/2007 | Matthews Brown | A47D 15/003 5/636 |
| 2008/0155792 | A1 * | 7/2008 | Yeh | A44B 11/04 24/169 |
| 2012/0192384 | A1 * | 8/2012 | Kelly | F16B 2/08 24/302 |
| 2014/0338157 | A1 * | 11/2014 | Iannello | A45F 5/02 24/318 |
| 2020/0107648 | A1 * | 4/2020 | Massale | A47C 31/11 |

* cited by examiner

- *Opening on side*
- *Thinner metal material*
- *2" Thick*

- *Opening on side*
- *Much thinner metal material*
- *1" Thick*

SLIPCOVER STRAP HOOK

CROSS-REFERENCE TO RELATED APPLICATION

This application claims benefit to U.S. Provisional App. No. 62/741,420, filed Oct. 4, 2018, which is hereby incorporated by reference herein in its entirety.

BACKGROUND

1. Field

This disclosure relates to slipcover hooks.

2. State of the Art

A slipcover is a removable cover for a piece of furniture, such as a chair of sofa. A slipcover may be a fitted cloth cover. Often, slipcovers have straps that can wrap around portions of the furniture to secure the slipcover to the furniture. Some straps can connect to other straps with hooks or buckles. FIGS. 1A and 1B shows two different slipcover hooks for securing slipcover straps. The hook in FIG. 1A has a generally "S" shape profile and has an opening on a side (right side in FIG. 1A) for passage of a fabric loop attached to the slipcover or furniture. FIG. 1B is similar to the hook in FIG. 1A in that it also has a generally "S" shape profile and a side opening for entry of a fabric loop. However, the space defined to receive the loop has a central tapering caused by an inverted "V"-shaped central member of the hook.

SUMMARY

According to one aspect, further details of which are described herein, a slipcover hook includes a first closed ring and a second open ring connected to the first closed ring. The first closed ring surrounds a first opening and is configured to connect to a strap extending through the first opening. The second open ring has opposed lateral sides and surrounds a second opening. The second open ring defines a slot through a perimeter wall thereof. The slot is in communication with the second opening and the slot is spaced from both lateral sides. The second open ring has two elongated portions with free ends oppositely facing one another across the slot. The slot is configured to receive a loop of fabric of a slipcover and the elongated portions are configured to be received in the loop of fabric.

The slipcover hook may be provided as part of a slipcover and/or a slipcover attachment strap assembly. Such a strap assembly may include the slipcover hook and a strap connected at its end to the hook. The strap may be adjustable to fit around a portion of a piece of furniture, such as a seatback portion of a chair or sofa. In embodiments, the strap is elastic. Adjustment of the strap can be used to tension the strap to additionally secure the strap and the slipcover to the furniture.

Though not shown in FIGS. 3A to 3E, the bottom side is a mirror image of the top side, and the left side is a mirror image of the right side.

FIGS. 1A-4B are drawn to scale, unless otherwise described herein.

DETAILED DESCRIPTION OF THE PREFERRED EMBODIMENTS

Figure 1A:
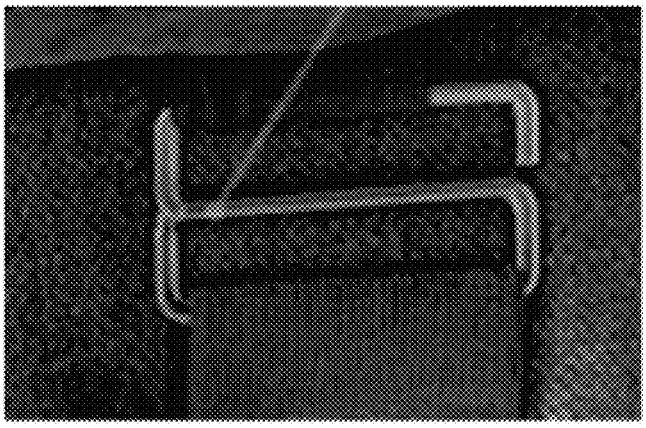
FIG. 1A (PRIOR ART)
FIG. 1A shows one prior art slipcover hook.
Figure 1B:
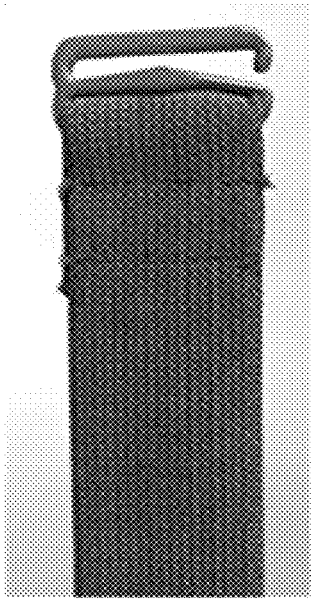
FIG. 1B (PRIOR ART)
FIG. 1B shows one other prior art slipcover hook.
Figure 2:
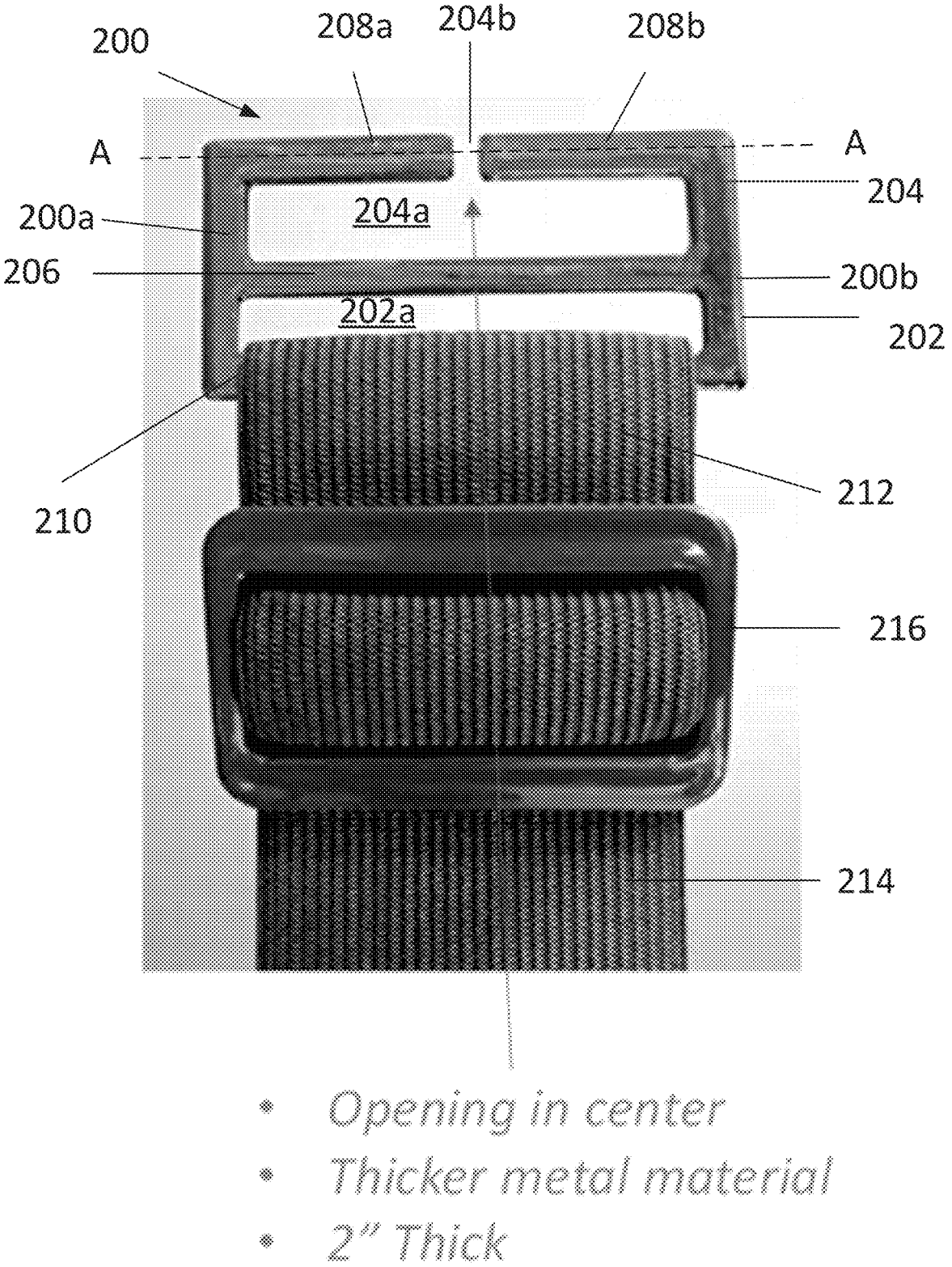
FIG. 2 shows an embodiment of a slipcover hook in accordance with an aspect of this disclosure.

FIG. 2 shows an embodiment of a slipcover hook 200. The hook 200 has opposed lateral sides 200*a* and 200*b*. The hook 200 has a first closed ring 202 and a second open ring 204. The first ring 202 is connected to the second ring 204. In the embodiment of the hook 200 shown in FIG. 2, the first and second rings 202, 204 are connected to each other along a common horizontal member 206, which separates a first opening 202*a* defined by the first closed ring 202, and a second opening 204*a* defined by the second open ring 204. The first ring 202 has a strap bar 210 that is configured to connect with a loop 212 of a fabric strap 214. Specifically, the first opening 202*a* is configured to receive a portion of a loop 212 of a fabric strap 214 that connects to the bar 210 and is configured to extend around a piece of furniture to which the slipcover is attached.

The second ring 204 has two arms or portions 208*a* and 208*b* that extend respectively from lateral sides 200*a* and 200*b* of the hook 200. The portions 208*a* and 208*b* are elongated along axis A-A and extend to free ends that oppose one another across a gap or opening 204*b*. The gap or opening 204*b* is on a perimeter of the second ring 204. The lengths of portions 208*a* and 208*b* along axis A-A are configured so that the gap or opening 204*b* permit the passage of an end (e.g., 312*a* and 312*b*) of loop 312 (FIGS. 4A and 4B) of fabric into the gap or opening 204*b* and over portions 208*a* and 208*b* of the hook 200. Specifically, each portion 208*a* and 208*b* is configured to be inserted into respective opposing ends 312*a* and 312*b* (FIG. 4B) of a respective elongated loop 312 of fabric of a slipcover 300, described in further detail herein.

Figure 3A:
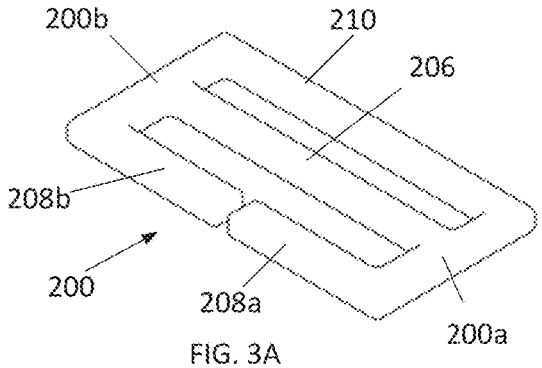
FIG. 3A is an isometric view of the slipcover hook shown in FIG. 2, viewed from top, front, and right sides thereof.
Figure 3B:
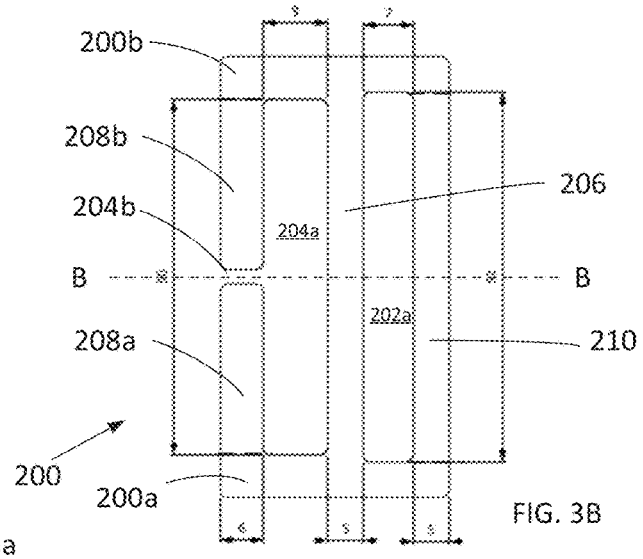
FIG. 3B is a top view of the hook shown in FIG. 3A.
Figure 3C:
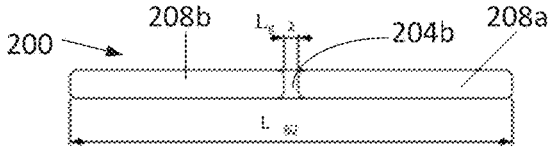
FIG. 3C is a front elevation view of the hook shown in FIG. 3A.
Figure 3D:
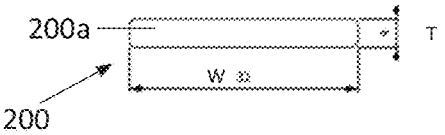
FIG. 3D is a right elevation view of the hook shown in FIG. 3A.
Figure 3E:
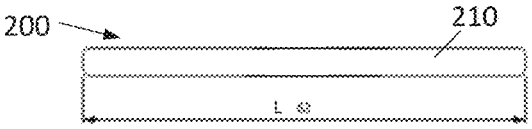
FIG. 3E is a rear elevation view of the hook shown in FIG. 3A.

Exemplary dimensions of the hook 200 are shown in FIGS. 3A to 3E. As shown in FIGS. 3C and 3D, the hook 200 has an overall length "L" of 62 mm. As shown in FIG. 3D, the hook 200 has an overall width "W" of 32 mm and a thickness "T" of 4 mm. In the embodiment, the thickness T is uniform throughout the hook 200. The gap 204*b* has a length "$L_g$" of 2 mm. The opening 202*a* has a width of 7 mm and a length of 52 mm. The opening 204*a* has a width of 9 mm and a length of 50 mm. Thus, openings 204*a* and 202*a* in the embodiment shown in FIGS. 3A to 3D have different dimensions. The openings 204*a* and 202*a* and gap 204*b* are all centrally aligned about axis B-B (FIG. 3B) that divides the length of the hook 200 at it center. Thus, in the embodiment in FIG. 3B, the portions 208*a* and 208*b* are of equal length, which is 24 mm. The width of portions 208*a* and 208*b* is 6 mm. The width of common member 206 is 5 mm. The width of It will be appreciated that the measurements can be scaled up or down to accommodate various fabric loops. Though not shown in FIGS. 3A to 3D, the bottom side is a mirror image of the top side, the left side is a mirror image of the right side.

Figure 4A:
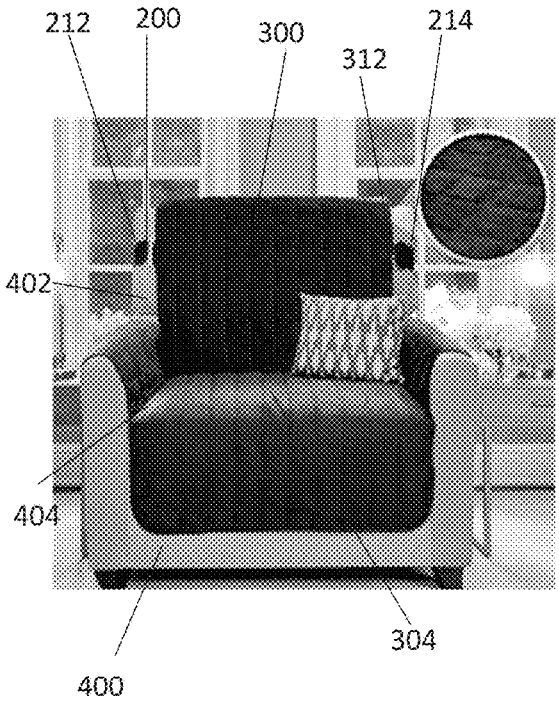
FIG. 4A shows a slipcover attached to a chair with a slipcover strap assembly in accordance with an aspect of the disclosure.
Figure 4B:
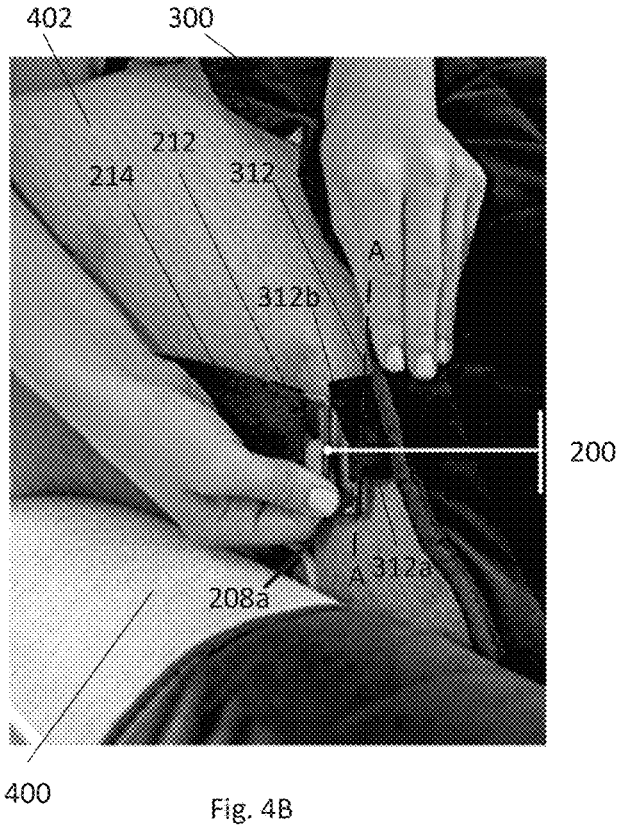
FIG. 4B shows additional details of the slipcover and slipcover strap assembly of FIG. 4A.

FIGS. 4A and 4B show a slipcover 300 that is covering at least a portion of a chair 400 (article of furniture). The slipcover 300 has a back portion 302 that covers a backrest portion 402 of the chair 400, and a seat portion 304 that covers a seat portion 404 of the chair 400. FIG. 4A shows the configuration of the slipcover 300 fully attached to a chair 400 (article of furniture). In FIG. 4A the strap 214 extends around a back side and lateral sides of the seatback portion 402 of the chair 400. Loops 212 at the ends of the strap 214 are connected to bar 210 of hook 200, as is also shown in FIG. 2. The portions 208*a* and 208*b* are also connected to the loops 312 on opposing sides of the seatback portion 302 of the slipcover. The length of the strap 214 can be adjusted with length adjusters (FIG. 216), if so provided, so that the strap can be tensioned around the seatback portion 402 of the chair. In embodiments, the strap 214 may be elastic so that it is self-tensioning or otherwise self-adjusting around the seatback portion 402.

As shown in greater detail in FIG. 4B, the fabric loops 312 are elongated and are configured to extend parallel with portions 208*a* and 208*b* along axis A-A when received onto those portions 208*a* and 208*b*. As shown in FIG. 4B, a first end 312*a* of loop 312 is configured to be inserted into the gap 204*b* (FIG. 2) and then slid onto the corresponding portion 208*a* of the hook 200. As shown in FIG. 4B, the second end 312*b* of the loop 312 is shown as not being received on portion 208*b* and not aligned with axis A-A. Thus, FIG. 4B shows an intermediate state of connection between the loop 312 and hook 200. It will be appreciated that a user can complete the connection of the loop 312 to the hook 200 by subsequently inserting the second end 312*b* of the loop into the gap 204*b* and sliding the second end 312*b* of the loop 312 over portion 208*b*, thereby drawing the entire loop 312 over both portions 208*a* and 208*b* and across the length of the gap 204*b* along axis A-A. The length of the gap 204*b* is sized to permit at least twice the thickness of the fabric of the loop 312 to enter the gap 204*b*, in either a compressed or uncompressed state of the fabric.

The dimensions and dimensional relationships discussed above may be critical to use of the hook 200 with the strap 214 and with the loop 312. For example, the length $L_g$ of the gap 204*b* and the lengths of portions 208*a* and 208*b* may be dimensioned so that ends 312*a*, 312*b* of a loop 312 of fabric can be received in the gap 204*b* and the loop 312 received over portions 208*a* and 208*b* while also being sized to prevent the loop 312 of fabric from being drawn back out over those portions 208*a* and 208*b* as a result of tension on the strap 214. For example, if the length of the gap Lg is too large, it may be possible to easily connect the portions 208*a* and 208*b* into the loop 312. However, if the length $L_g$ of the gap 204*b* is too large, tension on the strap 214 may allow the fabric of the loop 312 to easily gather together along its length and pull out of the gap 204*b*.

The hook may be made of various materials, including, but not limited to, metal (e.g., steel, brass, aluminum) and plastic (e.g., nylon).

There have been described and illustrated herein several embodiments of a slipcover hook and a method of using the hook. While particular embodiments of the invention have been described, it is not intended that the invention be limited thereto, as it is intended that the invention be as broad in scope as the art will allow and that the specification be read likewise. Thus, while particular dimensions have been disclosed, it will be appreciated that variations of those dimensions may be made. For example, while the first ring and the second ring of the hook 200 shown in FIGS. 2A to 3E have the same width between the lateral sides, in other embodiments, the widths may be different from one another. In addition, while particular types of materials for the construction of hooks have been disclosed, it will be understood that other materials can be used. Also, while a central gap or opening in the second ring is preferred, it will be recognized that an off-center gap or opening is also contemplated. It will therefore be appreciated by those skilled in the art that yet other modifications could be made to the provided invention without deviating from its spirit and scope as claimed.

What is claimed is:

1. A slipcover hook consisting of:

a first closed ring surrounding a first opening, the first closed ring configured to connect to a strap extending through the first opening; and a second open ring connected to the first closed ring, the second open ring having opposing lateral sides and surrounding a second opening, the second open ring defining a slot through a perimeter wall thereof, the slot being in communication with the second opening and the slot being spaced from both lateral sides, the second open ring having two elongated portions with free ends oppositely facing one another across the slot, wherein the slot is configured to receive a loop of fabric of a slipcover and the elongated portions are configured to be received in the loop of fabric, wherein the hook defines an outer length in a first direction that traverses at most only one of the first and second openings, and an outer width in a second direction perpendicular to the first direction, the second direction traversing the first and second openings, the outer length being consistent along the outer width of the hook, and the first opening having a first length extending in the first direction, and the second opening having a second length extending in the first direction, and the second length is greater than the first length.

2. The hook of claim 1, wherein the slot is located equidistantly from the lateral sides.

3. The hook of claim 1, wherein the first closed ring and the second open ring are coplanar.

4. The hook of claim 1, wherein the slot is configured to permit the passage of the loop of fabric through the slot so that the loop can be introduced into or removed from the opening surrounded by the second open ring.

5. A slipcover comprising:

a strap having ends with loops;

a slipcover hook configured to connect to respective loops of the strap, the slipcover hook consisting of:

a first closed ring surrounding a first opening, the first closed ring configured to connect to the loops of the strap; and a second open ring connected to the first closed ring, the second open ring having opposing lateral sides and surrounding a second opening, the second open ring defining a slot through a perimeter wall thereof, the slot being in communication with the second opening and the slot being spaced from both lateral sides, the second open ring having two elongated portions with free ends oppositely facing one another across the slot, wherein the slot is configured to receive a loop of fabric of a slipcover and the elongated portions are configured to be received in the loop of fabric, wherein the hook defines an outer length in a first direction that traverses at most only one of the first and second openings, and an outer width in a second direction perpendicular to the first direction, the second direction traversing the first and second openings, the outer length being consistent along the outer width of the hook, and the first opening having a first length extending in the first direction, and the second opening having a second length extending in the first direction, and the second length is greater than the first length; and a panel of material configured to cover a corresponding piece of furniture, the panel of material having at least one loop attached to a side of the panel, the at least one loop of the panel connected to the second open ring of the slipcover hook.

6. The slipcover according to claim 5, wherein:

the two elongated portions are received in the at least one loop of the panel.

7. A slipcover strap assembly comprising:

a strap having ends with loops; and a slipcover hook configured to connect to respective loops of the strap, the slipcover hook consisting of:

a first closed ring surrounding a first opening, the first closed ring configured to connect to the loops of the strap; and a second open ring connected to the first closed ring, the second open ring having opposing lateral sides and surrounding a second opening, the second open ring defining a slot through a perimeter wall thereof, the slot being in communication with the second opening and the slot being spaced from both lateral sides, the second open ring having two elongated portions with free ends oppositely facing one another across the slot, wherein the slot is configured to receive a loop of fabric of a slipcover and the elongated portions are configured to be received in the loop of fabric, wherein the hook defines an outer length in a first direction that traverses at most only one of the first and second openings, and an outer width in a second direction perpendicular to the first direction, the second direction traversing the first and second openings, the outer length being consistent along the outer width of the hook, and the first opening having a first length extending in the first direction, and the second opening having a second length extending in the first direction, and the second length is greater than the first length.

8. The slipcover strap assembly according to claim 7, wherein:

the strap is elastic.

9. The slipcover strap assembly according to claim 7, wherein:

the strap is adjustable in length.

10. The slipcover hook according to claim 1, wherein:

wherein the outer length is 62 mm and the outer width is 32 mm.

11. The slipcover hook according to claim 10, wherein:

the slipcover hook defines a thickness perpendicular to the outer length and outer width, and the thickness is 4 mm.

12. The slipcover hook according to claim 10, wherein:

the slipcover hook defines a uniform thickness perpendicular to the slipcover length and slipcover width.

13. The slipcover hook according to claim 1, wherein:

the slot is a gap of 2 mm between the elongated portions.

14. The slipcover hook according to claim 1, wherein:

the slipcover hook is laterally symmetrical.

15. The slipcover hook according to claim 1, wherein:

the first opening and the second opening have different dimensions.

16. The slipcover hook according to claim 1, wherein:

the first and second openings have different lengthwise dimensions relative to each other.

17. The slipcover hook according to claim 1, wherein:

the first opening has a width of 7 mm and a length of 52 mm, and the second opening has a width of 9 mm and a length of 50 mm.

18. The slipcover hook according to claim 1, wherein:

a common member separates the first and second openings, and the elongate portions have a width greater than a width of the common member.

19. The slipcover hook according to claim 18, wherein:

the width of common member is 5 mm, and the width of the elongate portions are 6 mm.

* * * * *